United States Patent [19]

Pelletier

[11] Patent Number: 4,866,809

[45] Date of Patent: Sep. 19, 1989

[54] COLLAPSIBLE TOOTHBRUSH CONSTRUCTION

[76] Inventor: Randy Pelletier, 80 Summit St., Manchester, Conn. 06040

[21] Appl. No.: 219,977

[22] Filed: Jul. 15, 1988

[51] Int. Cl.[4] ..... B41J 25/24

[52] U.S. Cl. ..... 15/167.1; 206/217; 206/218; 206/581; 132/308; 132/311; 220/8; 401/269

[58] Field of Search ..... 206/217, 218, 577, 581, 206/38; 132/308, 311; 220/8; 401/268, 269; 15/167.1

[56] References Cited

U.S. PATENT DOCUMENTS

| | | | |
|---|---|---|---|
| 1,521,783 | 1/1925 | Mendoza | 401/269 |
| 2,961,477 | 11/1960 | Slisz et al. | 220/8 |
| 3,114,468 | 12/1963 | Quase | 220/8 |
| 3,165,776 | 1/1965 | Tuseth | 132/308 |
| 3,746,162 | 7/1973 | Bridges | 206/361 |
| 3,880,281 | 4/1975 | Taddei | 132/308 |
| 3,890,986 | 6/1975 | Gerlich | 132/311 |
| 4,275,750 | 6/1981 | Clark | 132/311 |
| 4,521,128 | 1/1985 | O'Neal | 401/269 |
| 4,530,369 | 7/1985 | Adams | 15/167.1 |
| 4,624,382 | 11/1986 | Tonearelli | 220/8 |

FOREIGN PATENT DOCUMENTS

| | | | |
|---|---|---|---|
| 553273 | 5/1923 | France | 132/308 |
| 607850 | 7/1926 | France | 132/311 |
| 401378 | 4/1966 | Switzerland | 132/308 |

*Primary Examiner*—David T. Fidei

*Attorney, Agent, or Firm*—McCormick, Paulding & Huber

[57] ABSTRACT

A collapsible toothbrush as disclosed having three telescopically mounted portions defining the handle, all of which portions are hollow so as to receive in their collapsed condition a tube of toothpaste. The brush in its collapsed condition is preferably overwrapped with a small paper cup, and a cover is provided for the bristles. The entire assembly is shrink wrapped to permit dispensing from conventional vending machines.

5 Claims, 1 Drawing Sheet

COLLAPSIBLE TOOTHBRUSH CONSTRUCTION

This invention relates generally to collapsible toothbrushes, and deals more particlarly with a collapsible toothbrush assembly that is adapted to be fabricated from relatively inexpensive materials and to be packaged in a shrink wrapped hygienic sealed unit that can be readily dispensed from vending machines or the like.

One object of the present invention is to provide a relatively inexpensive package containing both the toothbrush, a toothpaste tube, and a container for water or the like so that the user will have available all the necessary equipment required for proper care of his teeth even during the day when personal dental care might not be possible or convenient, and while the user is away from home generally.

It is well know that for complete oral hygiene one should brush his teeth after each meal. Since most people do not have the necessary equipment available after each meal there is a definite need for a relatively inexpensive substitute for the personal utensils left in the home while a person is away at work or otherwise absent from his normal residence.

Combination toothpaste tubes and toothbrushes have been available and proposed in several prior art patents, but generally such devices are not particularly convenient to use, and may also be relatively expensive and hence not readily adapted for disposition and for sale at a relatively inexpensive price from vending machines or the like.

For example, the Fox U.S. Pat. No. 3,816,006 and 3,613,698 illustrate portable dental hygiene assemblies that are relatively expensive to manufacture and hence not particularly adapted for sale in vending machines at a reasonable price.

Prior art U.S. Pat. 4,344,535 illustrates an assembly that is more in line with the purpose served by the present invention, but the device requires a significant degree of manipulation by the user to provide the toothbrush in a condition such that it can be used. Although the handle does have a telescoping portion, this portion must be withdrawn from the container portion and reassembled with the container in order to provide the handle of the toothbrush in a condition suitable for use.

In accordance with the present invention a prepackaged toothbrush is provided with a toothpaste tube receptacle for receiving a small tube containing toothpaste in sufficient quantity to permit the user to brush his teeth at least once and perhaps more than once. The toothbrush itself includes three telescoping sections that form the handle and also form the cavity for the toothpaste tube. The bristle portion of the brush is adapted to be covered and the entire package with a paper cup wrapped around the handle is adapted to be shrink film wrapped for sanitary purposes in order to permit dissemination of the device through the medium of a vending machine or the like.

In its presently preferred form the assembly includes a brush portion in the form of a conventional toothbrush head. The head including several openings to receive depending tabs on a cover provided over the bristles. This cover will permit the bristles to be recovered so that the device can be stored for future use. Thus, the device of the present invention may be disposable but not necessarily so all in accordance with the overriding purposes of the present invention, and that is to provide a relatively inexpensive collapsible toothbrush construction.

The head of the brush includes a projecting portion that is tubular in configuration and defines a cavity for receiving a small tube of toothpaste. A tubular handle portion is telescopically received on the tubular projecting portion and means is defined in part by both the tubular handle portion and the tubular projecting portion so as to hold these portions in extended relationship with respect to one another during use of the toothbrush. In the collapsed or retracted position a second tubular portion is preferably provided externally of the first tubular handle portion and here again means is defined in part by these tubular handle portions for holding these portions in telescopically extended positions. In their collapsible conditions these three portions are provided with the projecting portion of the brush head inside the other two telescoped handle portions. This facilitates storage of the toothpaste tube and a paper cup is wrapped around the exterior of the larges tubular handle portion so that the entire assembly with the head covering the bristles can be shrink film wrapped in a form suitable for dispensing via a vending machine or the like.

DETAILED DESCRIPTION

Figures 1, 2:
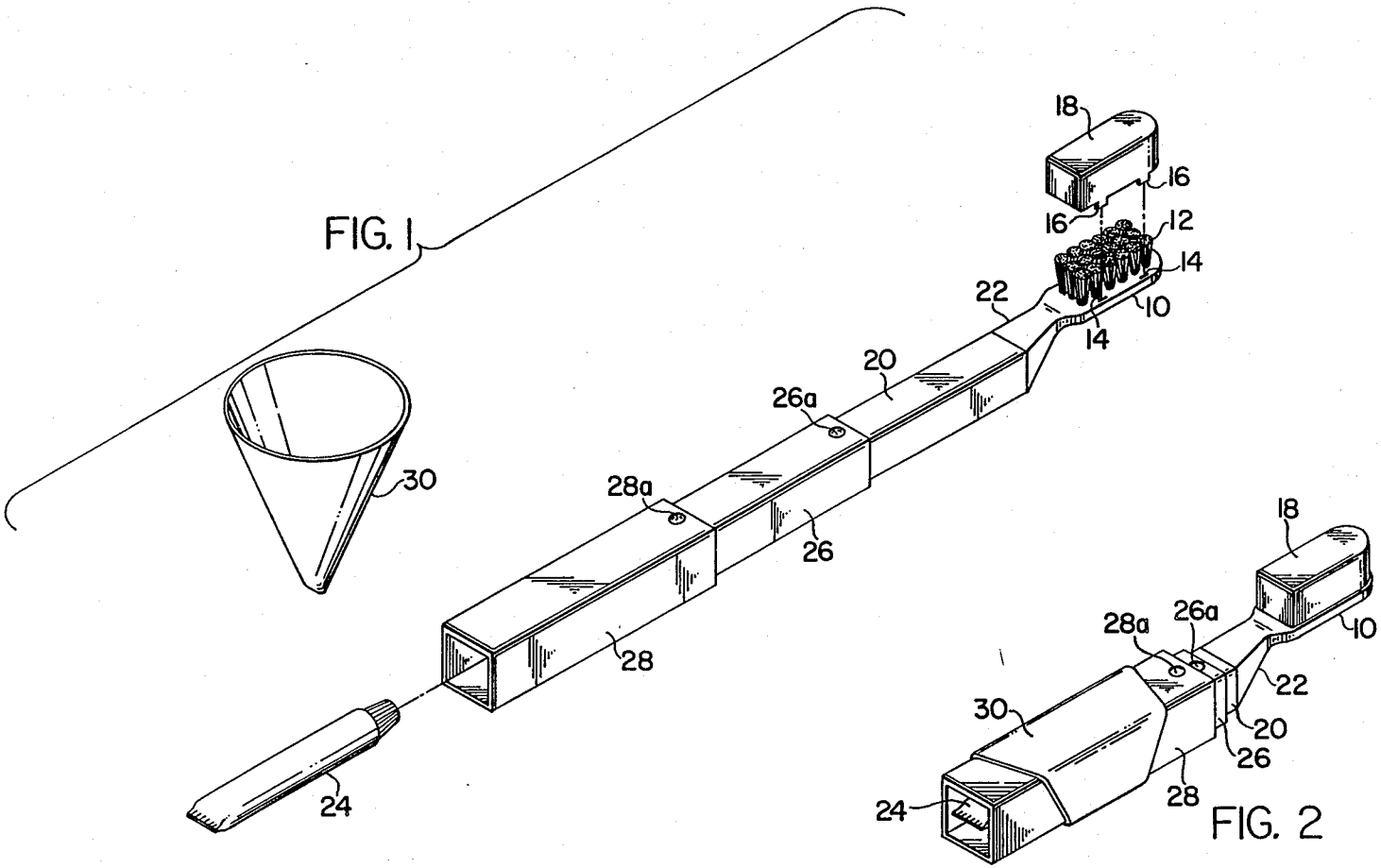
FIG. 1 is a perspective view showing in exploded relationship the various components of the collapsible toothbrush of the present invention.
FIG. 2 is a view of these components in their collapsed condition, and in a form suitable for shrink film wrapping.

Turning now to the drawing in greater detail, FIG. 1 shows a collapsible toothbrush constructed in accordance with the present invention and comprising a head 10 having conventional tufted bristles 12 provided in the head, and the head and bristles are conventionally constructed except for the slots 14, 14 provided in the head to receive tabs 16, 16 on a toothbrush cover 18 that is adapted to cover the bristles as suggested in FIG. 2.

The collapsible toothbrush further includes a hollow projecting portion 20 that is integrally connected to the head 10 by an intermediate portion 22 integrally formed with the tubular projecting portion 20 and the head 10. Thus, the tubular projecting portion 20 is hollow and is adapted to receive a small tube 24 of toothpaste when the toothbrush handle portion is collapsed from its extended position illustrated in FIG. 1 to its collapsed condition illustrated in FIG. 2.

A toothbrush handle includes the tubular projecting portion 20 and a slightly larger handle portion 26 that is slidable received on the exterior of the tubular projecting portion 20 so as to be movable from the position illustrated for it in FIG. 2 and to assume a telescopically extended position as shown in FIG. 1. Means is provided for holding these tubular portions 20 and 26 in extended relationship to one another and said means preferably takes the form of small opening 26a in the tubular handle portion 26 for receiving a dimple (not shown) formed in the tubular projecting portion 20.

A second tubular handle portion 28 is provided outside the tubular handle portion 26 first memtioned above, and here again the tubular handle portion 28 is adapted to be moved from its collapsed condition of FIG. 2 into an extended position as shown in FIG. 1, and to be held in this extended position by means in the form of the opening 28*a* in the larger tubular portion 28 that is adapted to receive a dimple (not shown) provided for this purpose on the first memtioned tubular handle portion 26. Similar openings and projections might be provided on the opposite side of the tubular portions 20, 26 and 28 so as to hold these portions in their collapsed condition as illustrated in FIG. 2. However, such holding means might not be necessary since the toothbrush assembly of FIG. 2 is adapted to be shrink film wrapped and hence sealed against whatever environment the assembly should be subjected to prior to purchase and use by the user.

Finally, a paper cup 30 is shown in FIG. 1 and can be wrapped around the second tubular handle portion 28 as suggested in FIG. 2 so as to provide a very compact assembly well adapted for use in a shrink wrapped package that can be handles with facility and a conventional vending machine.

I claim:

1. A collapsible toothbrush comprising a brush element having a head, bristles and a tubular projecting portion defining a cavity, a tubular handle portion slidably received on said tubular projecting portion, means defined in part by said tubular handle portion and in part by said tubular projecting portion for holding said portions in extended relation with respect to one another, said portions being telescopically movable relative to one another, and said tubular portions in retracted positions providing a compact easily packaged unit defining a cavity into which a small toothpaste tube can be received, as second tubular handle portion slidably received in said first mentioned tubular handle portion, means defined in part by said second tubular handle portion and in part by said first memtioned tubular handle portion for holding said first and second tubular handle portions in extended relationship with respect to one another, all said tubular portions being telescopically movable relative to one another, said tubular projecting portion having a length approximately equal to the length of said tubular handle portions so that in their telescopically collapsed condition said portions have a minimum overall length corresponding closely to the length of such small toothpaste tube, and detent means defined in part by some of said handle portions and projecting ball means defined in part by other of said handle portions cooperating with said detent means whereby said handle portions are held in their extended position, said handle portions being fabricated from a plastic material with sufficient resiliency to permit said detent and projecting ball means to releasably retain said handle portions in said extended and retracted positions.

2. The combination of claim 1 further characterized by a paper cup wrapped around said telescopically retracted tubular portions, and a cover for said bristles.

3. The combination of claim 2 wherein said cover has dependent tabs provided in openings defined by said head.

4. The combination of claim 3 further characterized by a shrink wrap film provided around at least a portion of said collapsed toothbrush portions together with said toothbrush head and cover.

5. The combination according to claim 1 wherein said tubular portions have a generally rectangular cross sectional shape and define a handle of generally rectangular configuration.

* * * * *